United States Patent [19]

Mais et al.

[11] 4,160,351

[45] Jul. 10, 1979

[54] FRONT FLAP OPENER

[75] Inventors: James W. Mais, South Euclid; David L. Bianchi, Kent; Theodore L. Barker, Hudson, all of Ohio

[73] Assignee: A-T-O Inc., Willoughby, Ohio

[21] Appl. No.: 870,619

[22] Filed: Jan. 19, 1978

[51] Int. Cl.[2] ..... B65B 43/39

[52] U.S. Cl. ..... 53/76; 53/382

[58] Field of Search ..... 53/76, 382

[56] References Cited

U.S. PATENT DOCUMENTS

| | | | |
|---|---|---|---|
| 3,852,942 | 12/1974 | Johnson et al. | 53/382 |
| 3,861,115 | 1/1975 | Peres | 53/382 X |

*Primary Examiner*—Travis S. McGehee

*Attorney, Agent, or Firm*—Oldham, Oldham, Hudak & Weber Co.

[57] ABSTRACT

Apparatus for opening the front flap of a container moving on a conveyor line toward a filling station. The invention includes a circular brush maintained above the conveyor line and rotatable by means of an air motor. The air motor is mounted upon a support member having rollers at the bottom thereof and movable between adjustable stops defining a track, the track running parallel to the conveyor. An air cylinder, pivotally mounted to a bracket at one end thereof, has an extendable rod connected to the top of the support member at another end thereof. Actuation of the air cylinder and air motor causes the rod to pass the rotating brush along the conveyor with the brush making lifting engagement with the front flap of the container. At the end of the track, the support member stops and the rod causes the brush to pass through an arc, assisting in the opening of the flap. A limit switch senses the arcuate motion of the brush and causes the rod to retract to an original position.

19 Claims, 3 Drawing Figures

FRONT FLAP OPENER

BACKGROUND OF THE INVENTION

The invention herein resides in the art of devices for packing or filling cartons and the like. More particularly, the invention comprises an improvement in apparatus for opening and folding outwardly the flaps of paperboard cases or cartons which, in a filling line, have previously had the flaps folded inwardly.

Heretofore in the art, it has been known to utilize shoes or the like for folding outwardly the side and rearward flaps of a container moving along a conveyor line in a filling system. These flaps have generally been opened with little difficulty in that they have an edge which may be easily accessed by the shoes or other opening apparatus. However, the opening of the front flap has posed serious problems in that the leading edge thereof is attached, at a scoreline, to the container proper. Various attempts have been made to circumvent these problems including the utilization of cam-actuated needles inserted under a side edge of the front flap and arcuately operated to fold the flap outwardly. Air guns or other such devices have been utilized in conjunction with such needles to blow a burst of air into the container with the rebounding air lifting the flap upwardly to make the same more accessible by the needle. Further, suction devices have been known in the art for opening the front flap.

The foregoing prior art has been plagued with numerous drawbacks. The cam-actuated needle, entering under a side edge of the front flap, often times tears or creases the flap, especially when the scoreline of the flap is discontinuous or of varying depth. Further, if the front flap is folded downwardly to a point within the container, the air gun and suction device aforementioned are often times insufficient to retrieve the flap. This problem is even more acute if the carton itself is twisted or cocked such that the front flap binds against a side wall thereof. Yet further, the prior art devices have generally been of a complex nature and not easily adjusted to accommodate various size boxes. Yet further, the prior art has taught the positioning of the front flap opener under the filling head itself, requiring a clearance between the filling head and the container sufficient to allow the front flap to open thereunder, thus necessitating an elevation mechanism associated with the filling station. Yet another drawback of the prior art is the generally large physical size of the front flap openers, taking up an inordinate amount of space at the filling station.

OBJECTS OF THE INVENTION

In light of the foregoing, it is an object of the instant invention to present a front flap opener wherein an opening force is centrally applied to the front flap at the trailing edge thereof.

Another object of the invention is to present a front flap opener which is easily adjusted to accommodate various sizes of containers.

A further object of the invention is to present a front flap opener which may, without accompanying air injection means, retrieve a front flap of a container which is maintained within the container and below a top horizontal plane thereof.

Yet another object of the invention is to present a front flap opener which is of a low profile and compact size, and which may be positioned immediately forward of the filling station to substantially reduce the elevation requirements at the filling station.

Still a further object of the invention is to present a front flap opener which is relatively inexpensive to construct, reliable in operation, easily constructed from state-of-the-art apparatus, and readily conducive to implementation with presently existing systems.

SUMMARY OF THE INVENTION

The foregoing and other objects of the invention, which will become apparent as the detailed description proceeds, are achieved by apparatus for opening the front flap of a container, comprising: first means for transporting containers in a predetermined direction, the containers having the front flap thereof folded inwardly of the container; second means rotatably positioned above said first means for engaging the front flap of the container; third means connected to said second means for transporting said second means in said predetermined direction; and fourth means operatively connected to said second and third means for sensing the presence of a container beneath said second means and thereupon actuating said second and third means.

DESCRIPTION OF THE DRAWINGS

For a complete understanding of the objects, structure and techniques of the invention, reference should be had to the following detailed description and accompanying drawings wherein.

DETAILED DESCRIPTION OF PREFERRED EMBODIMENT

Figure 1:
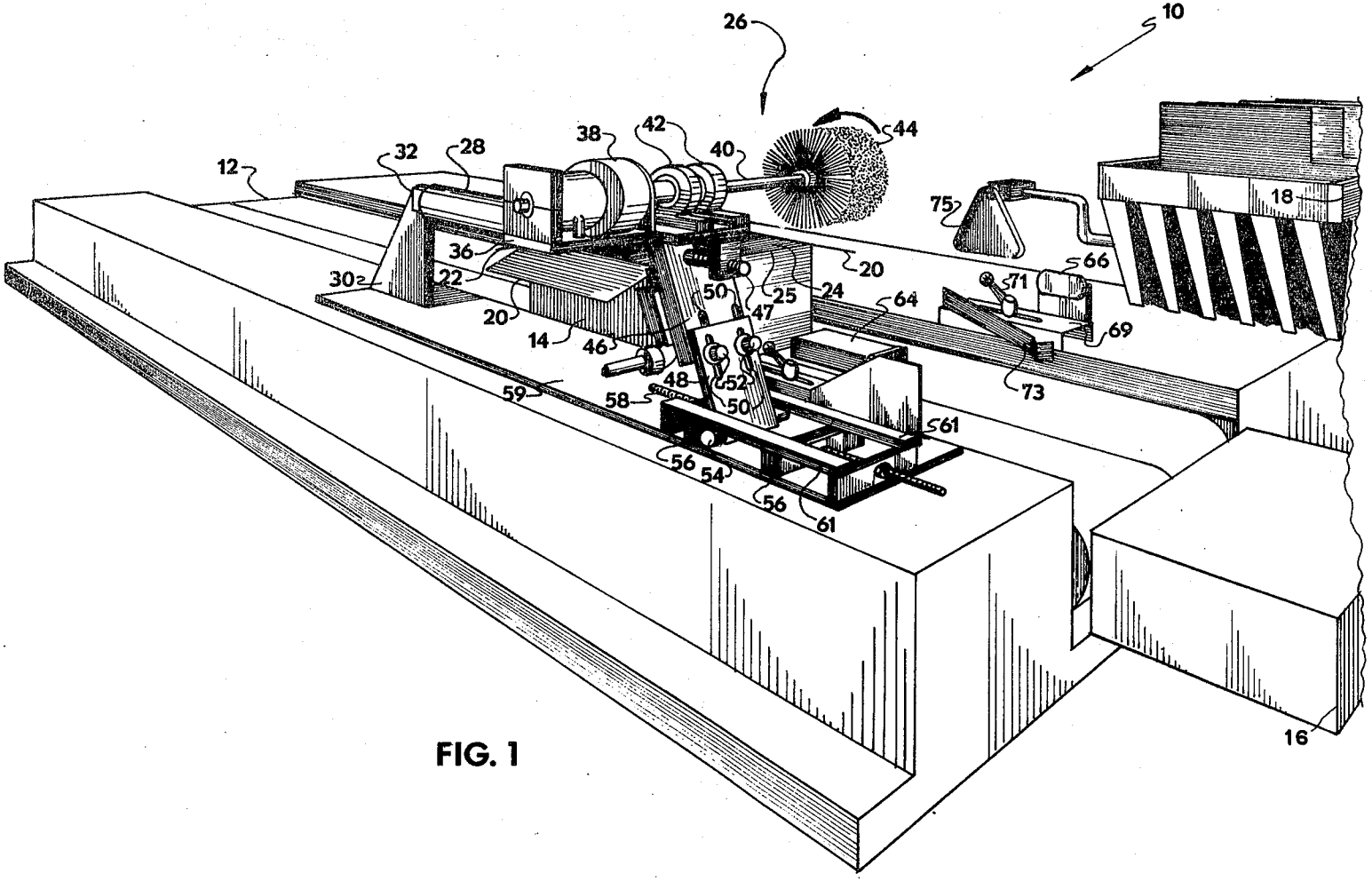
FIG. 1 is a top perspective view of the front flap opener of the invention.
Figure 2:
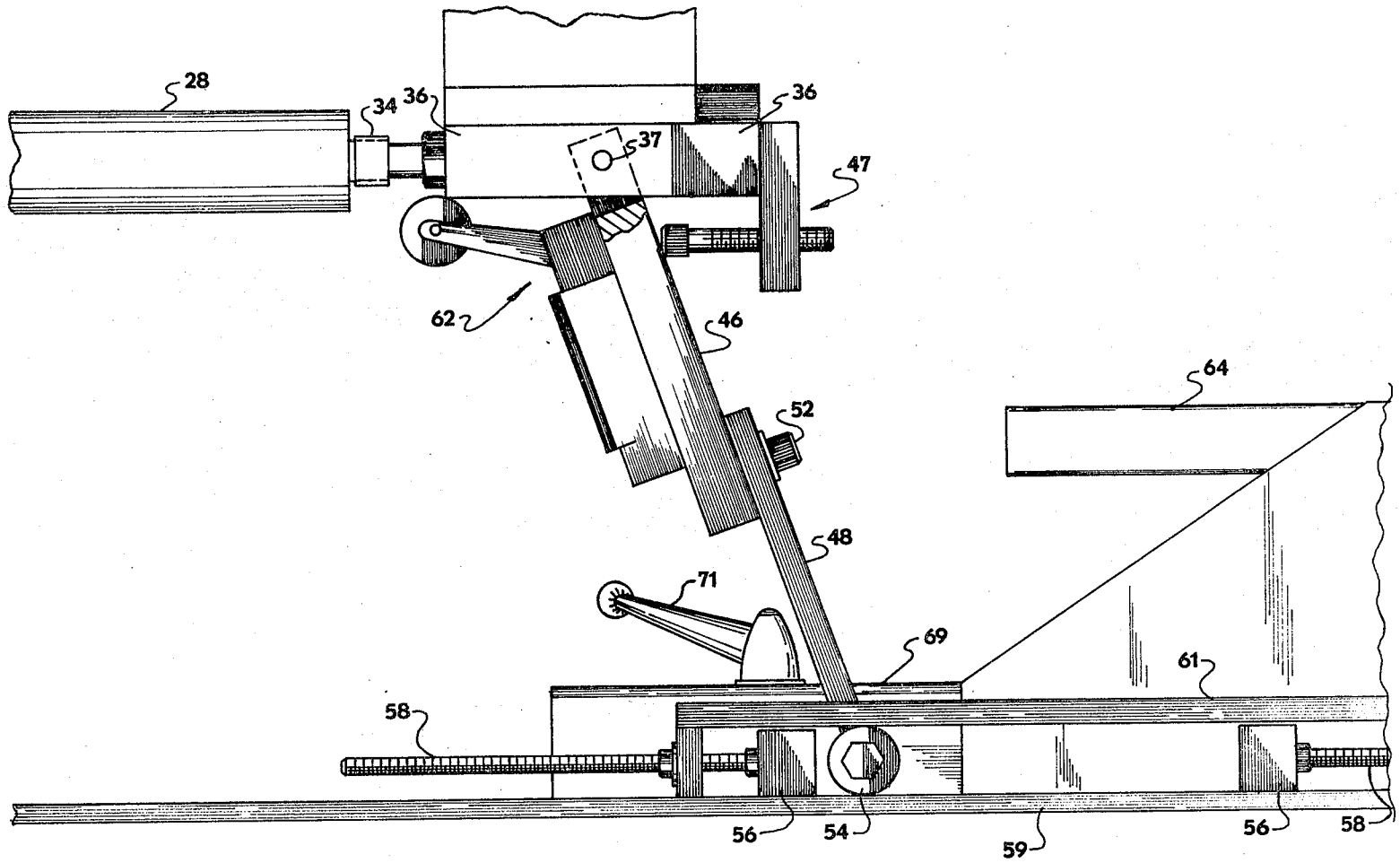
FIG. 2 is a side perspective view of the brush assembly of the invention, including its adjustable support bracket and track.

Referring now to the drawings, it can be seen that apparatus for conveying and filing cartons is designated generally by the numeral 10. The apparatus includes a conveyor device such as a belt 12 operative for transporting cases or containers 14 to a filling platform 16 positioned beneath a filling head 18. As shown in the drawings, the side flaps 20 and rear flap 22 of the container 14 have previously been folded outwardly by means of suitable prior art devices. The front flap 24, however, is still folded inwardly along a scoreline 25 as it passes towards the front flap opener designated generally by the numeral 26.

The front flap opener 26 includes an air cylinder 28 connected to a vertically extending bracket 30 at a pivot point 32. The pivot 32 may be of any suitable nature and may include a shaft mounted upn bearings and passing through the bracket 30 and connected to an end flange of the cylinder 28 to allow arcuate movement of the cylinder 28 within a vertical plane.

Extending from the air cylinder 28, and actuated in the standard manner, is a cylinder rod 34 which, under control of application and release of air pressure, may reciprocate into and out of the cylinder 28. The cylinder rod 34 is fixedly secured to a plate 36 having mounted thereon an air motor 38 or other suitable motor-type device. A shaft 40 is driven by the motor 38 through bearings 42, similarly mounted on the plate 36. Fixedly secured to the end of the shaft 40, and rotatable therewith, is a brush 44 constructed of relatively long, flexible nylon bristles. Preferably, the brush is of a diameter between five and seven inches with a similar width.

The mounting plate 36 is hingedly connected at 37 to a top plate 46 depending from the bottom side thereof. Movement between the mounting plate 36 and top plate 46 is defined by an adjustable stop 47 in one direction and a limit switch 62, to be discussed later, in the other. The top plate 46 is adjustably connected to a bottom plate 48. This adjustable interconnection is achieved by means of elongated slots 50 within the plates 46, 48 and bolts or other securing means 52 passing through the slots 50 and secured by means of nuts or the like. Maintained at a bottom edge of the plate 48 are rollers 54 which operate upon a track defined by stops 56, base plate 59, and restraints 61, preventing withdrawal of the rollers 54 from the track. The track length and position may be adjusted by means of adjustment members 58 rotatably attached to the stops 56 and passing through frame members 60. The adjustment members 58 may be threaded rods or bolts connected via a swivel joint to the associated stops 56.

Also included as part and parcel of the invention is a limit switch 62 attached to the top plate 46 or mounting plate 36 and in alignment with the cylinder rod 34. As will be discussed hereinafter, the rod 34 is operative for making contacting engagement with the limit switch 62 to assist in the operation of the control circuitry of the invention. Further included is a light source and sensor unit 64 which may include any suitable lamp for emitting light and a photocell or photodetector sensitive to light and operative for producing an electrical output in response thereto. A reflector 66 is positioned across the conveyor 12 and opposite the light source and sensor unit 64 such that light emitted from the lamp is reflected from the reflector and back to the sensor. Of course, the unit 64 could be solely a light source with the element 66 constituting a sensor, while still achieving the objects of the invention. The position of the unit 64 and reflector 66 is adjustable along the conveyor 12 by means of slots 67 within mounting brackets 69 and receiving appropriate securing means 71. Also attached to the brackets 69 are deflectable guides 73 for centering the containers 14 on the conveyor 12.

A pendulum 75 is suspended above the conveyor 12 for deflection by the opening of a front flap 24. When so deflected, the pendulum 75 swings back over the flap 24 and keeps the same folded outwardly after the brush 44 has terminated its opening operation. All flaps of the container 14 are thus open immediately prior to the filling station 16,18.

Figure 3:
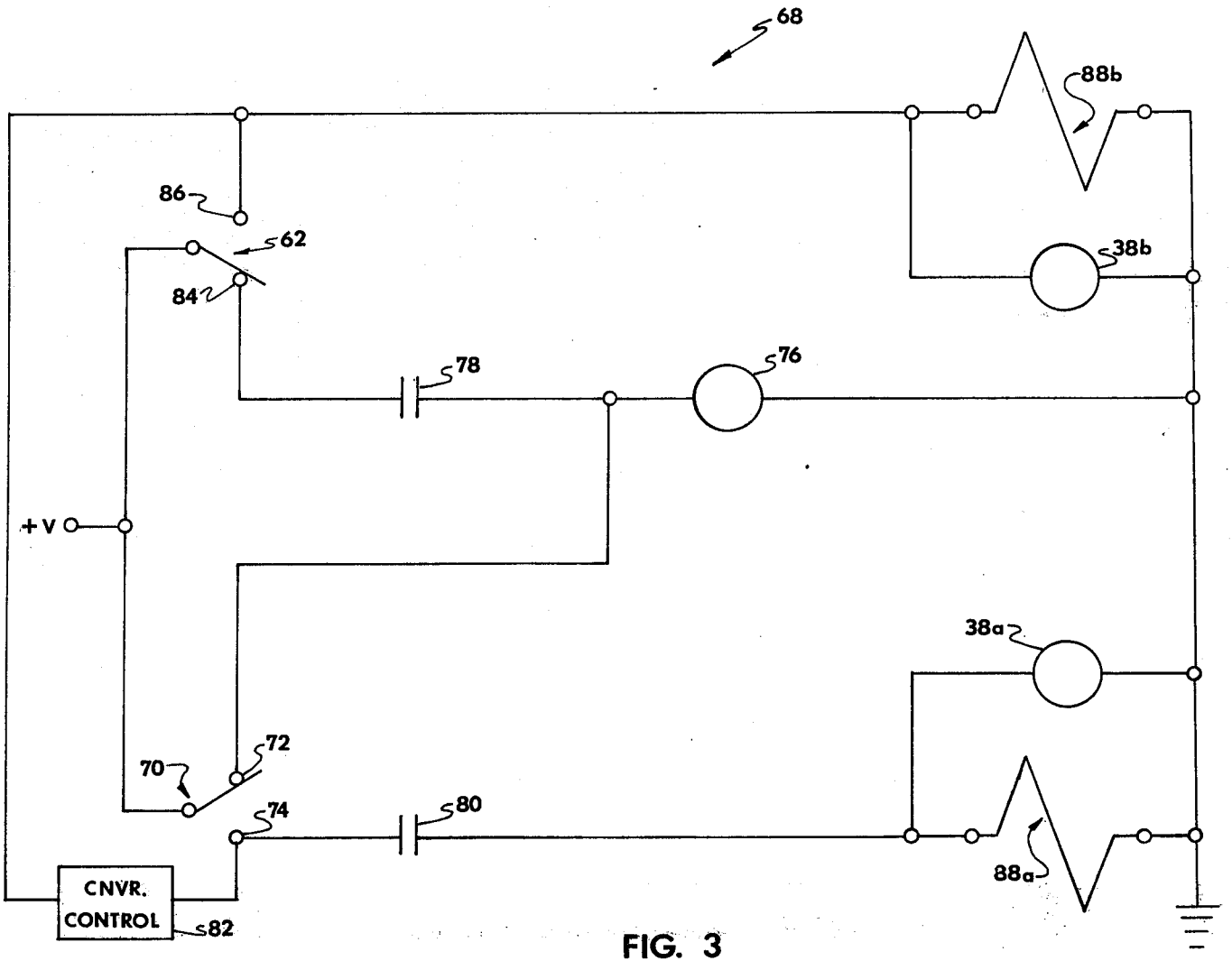
FIG. 3 is a schematic diagram of the control circuitry of the invention.

The operating control circuitry 68 of the invention is shown in FIG. 3 and reference is made thereto in light of the description presented above to achieve an understanding of the operation of the invention. As is seen in FIG. 3, a photoelectric control switch 70, constituting a portion of the element 64, connects a positive voltage supply to a relay 76 via a contact 72 when light is sensed by the photodetector. In this position, the relay 76 is energized and its contacts 78,80 are closed. There is thus presented a holding circuit from the voltage supply through terminal 84 of the limit switch 62 and across the contact 78. When the container 14, passing along the conveyor 12, cuts across the light path between the light source and sensor unit 64 and reflector 66, the photoelectric control switch 70 switches to contact 74 applying a voltage to the conveyor control circuit 82. The conveyor 12 is then stopped by means of the conveyor control circuit 82, the details of which are incidental to the teachings of the instant invention and readily ascertainable by one skilled in the art. At this instant in time, the cylinder rod 34 is in a contracted position with the rollers 54 being maintained against the front stop **56*a* of the track and the brush 44 being centrally positioned slightly behind the cut edge of the flap 24**.

The air solenoid valve **88*a* is actuated by the voltage applied across the contact 80, as is valve 38*a* of the air motor 38. The air motor 38 begins to rotate, instantaneously rotating the brush 44 via the shaft 40. Simultaneously, the air solenoid 88*a* of the air cylinder 28 causes the rod 34 to extend, rolling the rollers 54 along the track and toward the rear stop 56*b*. As the rollers 54 roll toward the rear stop 56*b*, the rotating brush 34 engages the center of the cut edge of the front flap 24 and begins to lift the same. As the rollers 54 come into engagement with the rear stop 56*b*, the air cylinder 28 pivots about the interconnection 32, allowing the rod 34 to continue to elongate, forcing the support member comprising plates 46,48 to pivot about the stopped rollers 54 and causing the brush 44 to sweep through an arc. This arcuate motion of the brush 44 assists the outward opening of the front flap 24 which deflects the pendulum 75. The pendulum 75 then swings back over the opened flap 24** and secures the same in an open position.

As the brush 44 passes through the peak of its arcuate motion, the rollers 54 slide back along the track to the front stop **56*a*. At this point in time, the hinged interconnection 37 between the mounting plate 36 and top plate 46 allows contacting engagement between the limit switch 62 and the rod 34. This contacting engagement results in a switching of power from the contact 84 of the switch 62 to the contact 86. The holding circuit of the relay 76 is thus opened, opening the contacts 78,80 and terminating actuation of the air solenoid 88*a* and valve 38*a* to the air motor 38. The motor 38 stops spinning, and elongating movement of the rod 34** is terminated.

Actuation of the limit switch 62 applies power to the conveyor control circuit 82 via the contact 86 and the conveyor again begins to move. Power is also applied to the return solenoid **88*b* to begin to withdraw the rod 34 to its contracted position. When the rod reaches its contracted position, it remains there until the cycle begins again. In the meantime, the conveyor control 82 has caused the transporting of the container 14 through the light path of the photoelectric switch 64,66, and the same awaits the leading edge of the next container. It should be understood that, if an arcuate motion of the brush 44 is not desired, to limit switch 62 could be positioned on the rear stop 56*b* for actuation by the bottom edge of plate 48. The rod 34 would then withdraw to its contracted position as soon as the track length had been traversed by the rollers 54**.

The conveyor 12 deposits the container 14 on the loading platform 16 where it is filled via the filling head 18 in standard fashion. Since the front flap opener 26 is positioned ahead of the loading station 16,18, the clearance between the head 18 and platform 16 may be maintained at a minimum, thus reducing the elevation required to bring the platform 16 into operative position with the filling head 18.

It will be appreciated to those skilled in the art that the solenoids **88*a*,88*b* could simply comprise a double-ended solenoid. That is, the two solenoids could be on one valve body with the "plumbing" interconnection of the valve achieving the desired function. Further, there could be included across the solenoid valve 88b a second air motor valve 38b which, again via the "plumbing", would drive in a reverse direction from that of the other valve 38a. If such were the case, the apparatus 26 could be incorporated as both a front flap and rear flap opener with the switching of the limit switch 62 causing the motor 38 to drive in a reverse direction to open the rear flap. In such a case, apparatus would not be required to open the rear flap 22 prior to reaching the unit 26**.

It should further be appreciated that while the instant embodiment has been presented with respect to air cylinders and air motors, it is well within the capabilities of one skilled in the art to implement the same utilizing an electric motor and electric drive pistons to achieve the same objects. Further, pneumatic sensing means and valves could be used to control the sequencing of the system, obviating the need for any electrical control circuitry. Such embodiments are deemed to be included within the spirit of the instant invention. Further, the air pressure sources and interconnections for the disclosed embodiment have not been shown since the same are believed to be readily perceived by a routineer in the art.

Attention is now directed to the adjustability feature of the invention, allowing the same to adapt to various sizes of cartons and containers. Positioning the brush 44 to fall slightly below the top plane of the containers is easily achieved through the adjustment provided by the slots 50 and bolts 52 mentioned above with respect to the interconnection of plates 46,48. The front stop 56a is set via its associated adjustment member 58, with due considerations to the position of the photodetector system 64,66, such that the brush 44 is slightly behind the cut edge of the front flap 24 when the system 64,66 senses a container. The size of the flap 24 then determines the positioning of the rear stop 56b via its adjustment member 58 so that arcuate motion of the brush 44 occurs with the arc defined by the opening of the flap 24.

Thus, it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Consequently, for an appreciation of the true scope and breadth of the invention, reference should be had to the appended claims.

What is claimed is:

1. Apparatus for opening the front flap of a container, comprising:

first means for transporting containers in a predetermined direction, the containers having the front flap thereof folded inwardly of the container;

second means comprising a brush rotatably mounted upon a shaft and positioned above said first means for engaging the front flap of the container;

third means connected to said second means for transporting said second means in said predetermined direction; and fourth means operatively connected to said second and third means for sensing the presence of a container beneath said second means and thereupon actuating said second and third means.

2. The apparatus according to claim 1 wherein said third means comprises an extendable rod connected to a support member, a bottom edge of said support member being movable upon a track, and a top edge thereof receiving said rotatable shaft.

3. The apparatus according to claim 2 wherein said bottom edge has rollers thereon and wherein said track is defined by adjustable stops, said rollers moving between said adjustable stops under control of said extendable rod.

4. The apparatus according to claim 2 wherein said support member comprises upper and lower elements, adjustably interconnected for positioning of said brush into aligned position with the tops of the containers.

5. The apparatus according to claim 2 wherein said extendable rod is connected to an air cylinder, said air cylinder being pivotally connected to a vertical support member, and wherein said second means further includes an air motor connected to said shaft.

6. The apparatus according to claim 5 which further includes switch means connected to said air cylinder for reversing operation of said air cylinder after said rod has extended a predetermined amount.

7. The apparatus according to claim 6 wherein said air motor is pivotally mounted atop said support member, pivotal movement of said motor actuating said switch means.

8. The apparatus according to claim 5 wherein said first means comprises a conveyor system, said second, third, and fourth means maintained along said conveyor system, and further including a station for filling the containers at an end of said conveyor system and following said second, third, and fourth means.

9. In a system for transporting containers along a conveyor line and to a loading station, the containers having the front flaps thereof folded inwardly of the box, the improvement comprising:

a rotatable brush centrally positioned above the conveyor line at a level aligned with the top of the containers;

a motor connected to and driving said brush, said motor being mounted upon a support member which is movable upon a track;

reciprocating means connected to said support member for reciprocatingly driving said support member upon said track; and sensing means positioned along said conveyor line and interconnected with said motor and reciprocating means for sensing the presence of a container beneath said brush and thence actuating said motor and reciprocating means.

10. The improvement according to claim 9 wherein said track is defined by adjustable stops at each end thereof.

11. The improvement according to claim 10 wherein said reciprocating means includes a rod operative within a cylinder and connected to said support member, said rod driving said support member to one of said stops, and thence moving said brush through an arc.

12. The improvement according to claim 9 wherein said motor is hingedly mounted atop said support member.

13. The improvement according to claim 12 which further includes switch means actuated by hinged movement of said motor for terminating actuation of said motor and returning said reciprocating means to an initial position.

14. The improvement according to claim 9 wherein said support member includes means for adjusting the length thereof.

15. The improvement according to claim 9 wherein said reciprocating means comprises a rod operative within a cylinder, said cylinder being pivotally connected to a brace, said support member being connected to said rod and having rollers at the bottom thereof and movable between stops upon said track.

16. The improvement according to claim 9 wherein said sensing means comprises a photodetector.

17. The improvement according to claim 9 wherein said motor is a reversible air motor and said reciprocating means comprises an air cylinder.

18. The improvement according to claim 9 wherein said brush is comprised of a plurality of radially extending, long, flexible bristles.

19. The improvement according to claim 18 which further includes a weighted pendulum pivotally suspended above the conveyor line between said brush and the loading station.

* * * * *